US008082826B2

(12) United States Patent
Keller et al.

(10) Patent No.: US 8,082,826 B2
(45) Date of Patent: Dec. 27, 2011

(54) SAW ACCESSORIES AND CLAMP FOR USE THEREWITH

(75) Inventors: David V. Keller, Jackson, TN (US); Mark D. Hickok, Waukesha, WI (US); Peter L. Domeny, Northbrook, IL (US); Thornton H. Gogoll, III, Baltimore, MD (US); David G. Peot, Easley, SC (US); Stan M. Rodrigues, Pleasnaton, CA (US); Christopher S. Tennant, Clemson, SC (US)

(73) Assignee: Power Tool Institute, Cleveland, OH (US)

( * ) Notice: Subject to any disclaimer, the term of this patent is extended or adjusted under 35 U.S.C. 154(b) by 398 days.

(21) Appl. No.: 12/054,934

(22) Filed: Mar. 25, 2008

(65) Prior Publication Data

US 2009/0241746 A1 Oct. 1, 2009

(51) Int. Cl.
*B27G 19/02* (2006.01)

(52) U.S. Cl. ..... 83/102.1; 83/478

(58) Field of Classification Search ..... 83/102.1, 83/478, 477.2, 467.1, 452, 453
See application file for complete search history.

(56) References Cited

U.S. PATENT DOCUMENTS

| | | | |
|---|---|---|---|
| 513,138 | A | 1/1894 | Pickett |
| 713,196 | A | 11/1902 | Bennett |
| 1,082,870 | A | 12/1913 | Humason |
| 1,089,223 | A | 3/1914 | Jenkins |
| 1,148,169 | A | 7/1915 | Howe |
| 1,255,886 | A | 2/1918 | Jones |
| 1,258,961 | A | 3/1918 | Tattersall |
| 1,379,802 | A | 5/1921 | Cooper |
| 1,381,612 | A | 6/1921 | Anderson |
| 1,465,224 | A | 8/1923 | Lantz |
| 1,662,372 | A | 3/1928 | Ward |
| 1,720,535 | A | 7/1929 | Wold |
| 1,879,280 | A | 9/1932 | James |
| 1,993,219 | A | 3/1935 | Merrigan |
| 2,007,887 | A | 7/1935 | Tautz |
| 2,095,330 | A | 10/1937 | Hedgpeth |

(Continued)

FOREIGN PATENT DOCUMENTS

DE 910 835 C 5/1954

(Continued)

OTHER PUBLICATIONS

Brett-Guard Original Mount Saw Guard printed from http://www.htcproductsinc.com/bgom.html on Jul. 2, 2007, 1 page.

(Continued)

*Primary Examiner* — Stephen Choi
(74) *Attorney, Agent, or Firm* — K&L Gates LLP

(57) ABSTRACT

In at least one form of the invention, a clamp can be used to attach a saw accessory to a saw. In various embodiments, the clamp can comprise first and second clamping members, an actuator, and a controller. In various embodiments, the saw accessory can be disposed between the first and second clamping members where at least one of the first and second clamping members can be moved by the actuator in order to clamp the saw accessory therebetween. In at least one such embodiment, the controller can be in electrical and/or fluid communication with the actuator to activate the actuator. In various embodiments, the controller can be activated by an operator from a location proximate to the operator but remote from a blade of the saw.

18 Claims, 18 Drawing Sheets

U.S. PATENT DOCUMENTS 2,247,314 A 6/1941 Sellmeyer
2,328,244 A 8/1943 Woodward
2,352,235 A 6/1944 Tautz
2,425,331 A 8/1947 Kramer
2,520,415 A 8/1950 Le Bovit
2,524,168 A 10/1950 Harnish et al.
2,530,867 A 11/1950 Galanga
2,593,596 A 4/1952 Olson
2,623,555 A 12/1952 Eschenburg
2,731,049 A 1/1953 Akin
2,913,926 A 11/1959 Hammond
3,038,508 A 6/1962 Wilson
3,101,104 A 8/1963 Sullivan
3,232,326 A 2/1966 Speer et al.
3,302,669 A 2/1967 Edler
3,348,836 A 10/1967 Smierciak
3,609,895 A 10/1971 Wyckoff
3,667,990 A 6/1972 Rogers
3,731,520 A 5/1973 Hickman et al.
3,787,982 A 1/1974 Anderson
3,851,557 A * 12/1974 Vierstraete ..... 83/453
3,949,636 A 4/1976 Ball et al.
4,076,227 A 2/1978 Rameson
4,370,909 A 2/1983 Jennings
4,418,597 A 12/1983 Krusemark et al.
4,614,140 A 9/1986 Macksoud
4,615,247 A 10/1986 Berkeley
4,625,604 A 12/1986 Handler et al.
4,721,023 A 1/1988 Bartlett et al.
4,747,613 A 5/1988 Brichoud et al.
5,044,236 A * 9/1991 Mills ..... 83/29
5,174,349 A 12/1992 Svetlik et al.
5,235,752 A 8/1993 Sauerwein et al.
5,245,903 A 9/1993 Armentrout
5,287,779 A 2/1994 Metzger, Jr.
5,316,061 A 5/1994 Lee
5,317,944 A 6/1994 Hewitt
5,375,495 A 12/1994 Bosten et al.
5,447,085 A 9/1995 Gochnauer
5,461,791 A 10/1995 Piety
5,918,521 A 7/1999 Sartori et al.
6,022,010 A 2/2000 Bernstein
6,170,370 B1 1/2001 Sommerville
6,216,575 B1 4/2001 Dils
6,263,584 B1 7/2001 Owens
6,334,380 B1 * 1/2002 Huang ..... 83/471.2
6,370,997 B1 4/2002 Rugen et al.
6,405,624 B2 6/2002 Sutton
6,418,829 B1 7/2002 Pilchowski
6,422,116 B1 7/2002 Kenyon et al.
6,502,809 B1 1/2003 Gionta
6,543,324 B2 4/2003 Dils
6,578,461 B1 6/2003 Loo
6,591,725 B1 * 7/2003 Martin ..... 83/471.3
6,688,202 B2 2/2004 Parks et al.
6,715,388 B1 4/2004 Jaksha
6,736,042 B2 5/2004 Behne et al.
6,826,992 B1 12/2004 Huang
6,840,144 B2 1/2005 Huang
6,853,300 B2 2/2005 Kuan
6,900,728 B2 5/2005 Metzger, Jr.
6,986,370 B1 1/2006 Schoene et al.
7,013,574 B2 3/2006 Plunkett
7,044,039 B2 5/2006 Powell
7,066,627 B1 6/2006 Chen
7,137,327 B2 11/2006 Garcia et al.
7,210,386 B1 5/2007 Chang
7,226,179 B2 6/2007 Garcia et al.
7,228,773 B2 6/2007 Powell
7,234,380 B2 6/2007 Garcia
7,249,992 B2 7/2007 Kalenian et al.
7,267,038 B2 9/2007 Gehret et al.
7,540,223 B2 6/2009 Sasaki et al.
7,827,890 B2 11/2010 Gass et al.
2002/0170399 A1 11/2002 Gass et al.
2004/0011177 A1 * 1/2004 Huang ..... 83/478
2004/0040169 A1 3/2004 Davis
2004/0118264 A1 6/2004 Chen
2004/0187666 A1 9/2004 Huang
2004/0194594 A1 10/2004 Dils et al.
2004/0246132 A1 12/2004 Kuan
2004/0255745 A1 12/2004 Peot et al.
2004/0261592 A1 12/2004 Chen
2005/0160895 A1 7/2005 Garcia et al.
2005/0166736 A1 8/2005 Gass et al.
2005/0193881 A1 9/2005 Liao et al.
2005/0211034 A1 9/2005 Sasaki et al.
2005/0211039 A1 9/2005 Lo et al.
2005/0248303 A1 11/2005 Garcia et al.
2005/0252187 A1 11/2005 Gass et al.
2006/0011034 A1 1/2006 Gehret et al.
2006/0042441 A1 3/2006 Ichikawa et al.
2006/0096428 A1 5/2006 Garcia et al.
2006/0101960 A1 5/2006 Smith et al.
2006/0101961 A1 5/2006 Etter et al.
2006/0101969 A1 5/2006 Garcia et al.
2006/0155582 A1 7/2006 Brown
2006/0203469 A1 9/2006 Niemann
2006/0260456 A1 11/2006 Chang
2007/0000366 A1 1/2007 Peot et al.
2007/0056416 A1 3/2007 Shibata
2007/0056418 A1 3/2007 Lung et al.
2007/0113714 A1 5/2007 Burke et al.
2007/0113715 A1 5/2007 Burke et al.
2007/0186739 A1 * 8/2007 Peot et al. ..... 83/102.1
2007/0234584 A1 10/2007 Robins
2008/0016998 A1 1/2008 Keller
2009/0241745 A1 10/2009 Keller et al.
2009/0241748 A1 10/2009 Keller et al.
2010/0037739 A1 2/2010 Anderson

FOREIGN PATENT DOCUMENTS

DE 20 2006 013 323 U1 11/2006
EP 2017025 A1 1/2009
FR 2595579 A1 9/1987
GB 2273078 A 6/1994
JP 2005-262337 A 9/2005
WO WO 03/006213 A2 1/2003

OTHER PUBLICATIONS

Details for Table Saw Pop-In Splitter—Rockler Woodworking Tools, printed from http://www.rockler.com/product.cfm?Offerings_ID=10889&TabSelect=Details, printed Jun. 5, 2007, 3 pages.
International Preliminary Report on Patentability and Written Opinion of the International Searching Authority issued Sep. 28, 2010 in International Application No, PCT/US2009/037400.
International Search Report nd Written Opinion mailed Jun. 19, 2009 in International Application No. PCT/US2009/037400.

* cited by examiner

SAW ACCESSORIES AND CLAMP FOR USE THEREWITH

BACKGROUND

1. Field of the Invention

The present invention generally relates to saws and, more particularly, to clamps for mounting saw accessories thereto.

2. Description of the Related Art

Saws often include safety devices, or saw accessories, that can protect an operator from being injured while using the saw. Table saws, for example, can include saw accessories such as a blade guard, a riving knife, a splitter, and/or one or more anti-kick-back pawls. The blade guard can be disposed over and/or around a saw blade to reduce the likelihood that the operator may accidentally touch the saw blade. The riving knife or splitter may be mounted to the saw in alignment with the blade such that the riving knife or splitter can be positioned within and/or engage a slot, or kerf, in a workpiece created by the blade. As a result, the riving knife or splitter can prevent, or at least partially inhibit, portions of the workpiece from pinching onto the blade and kicking back or lifting upwards toward the operator. In various embodiments, one or more anti-kick-back pawls can be attached to the blade guard and/or riving knife, for example, in such a manner as to prevent, or at least partially inhibit, the workpiece from lifting upwardly by forcing the workpiece against a work surface of the saw.

The saw accessories described above are typically mounted to the saw at a location underneath the work surface via fasteners and/or bolts, for example. In various embodiments, the operator must first remove a throat plate surrounding the saw blade to access the fasteners or bolts in order to make adjustments to, or swap, the saw accessory. In at least one embodiment, the operator must use a wrench, for example, configured to engage the bolts disposed underneath the work surface. In various embodiments, as a result of the above, the operator must often work near the saw blade to adjust, install, and/or remove the saw accessory.

As outlined above, riving knives, for example, can be mounted to the table saw in order to protect the operator. Generally, previous riving knives have included at least two portions, a first portion configured to attach the riving knife to the saw and a second portion configured to fit within the kerf of the workpiece as described above. Previously, for any particular riving knife, though, the first and second portions have had the same thickness. In various circumstances, as a result, several riving knives have been provided to the operator where each riving knife has had a different thickness. The different thicknesses of the riving knives, however, have created difficulties in mounting the riving knives to the saw. More particularly, owing to the design of several previous clamping mechanisms, the clamping force available to hold the attachment portions of thicker riving knives was typically different than the clamping force available to hold the attachment portions of thinner riving knives. Such differences in the clamping force have made these clamps somewhat unreliable causing the operator to either not use the riving knives or to use an unsuitable riving knife for their application. What is needed is an improvement over the foregoing.

SUMMARY

In at least one form of the invention, a clamp can be used to attach a saw accessory to a saw. In various embodiments, the clamp can comprise first and second clamping members, an actuator, and a controller. In at least one embodiment, the saw accessory can be disposed between the first and second clamping members where at least one of the first and second clamping members can be moved by the actuator in order to clamp the saw accessory therebetween. In at least one such embodiment, the controller can be in electrical and/or fluid communication with the actuator to activate the actuator. In various embodiments, the controller can be activated by an operator from a location proximate to the operator but remote from the saw blade.

In at least one form of the invention, a clamp can include a first clamping member, a second clamping member, a connecting member, and a lever. In at least one embodiment, the connecting member can include a cable, wherein the cable can be operably connected to the lever and to at least one of the first and second clamping members. In such embodiments, upon movement of the lever by the operator, at least one of the first and second clamping members can be moved relative to the other clamping member to clamp the saw accessory therebetween. In various circumstances, the lever can permit an operator to activate the clamp and engage the saw accessory while remaining positioned remote from the saw blade.

In at least one form of the invention, a kit can include two or more saw accessories, such as riving knives, for example, wherein at least a portion of the saw accessories can be configured to fit between the first and second clamping members. In various embodiments, each riving knife, for example, can include an attachment portion and a kerf portion, wherein the kerf portion can be configured to engage a kerf in a workpiece created by a saw blade as outlined above. In at least one embodiment, the kerf portions of each of the riving knives can have different thicknesses in order to accommodate kerfs created by saw blades having different thicknesses. In various embodiments, the attachment portions of each riving knife, though, may have the same, or substantially the same, thickness such that a clamping force provided by the saw accessory clamp can be the same, or substantially the same, regardless of the riving knife selected.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate various embodiments of the invention, in one form, and such exemplifications are not to be construed as limiting the scope of the invention in any manner.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 1:
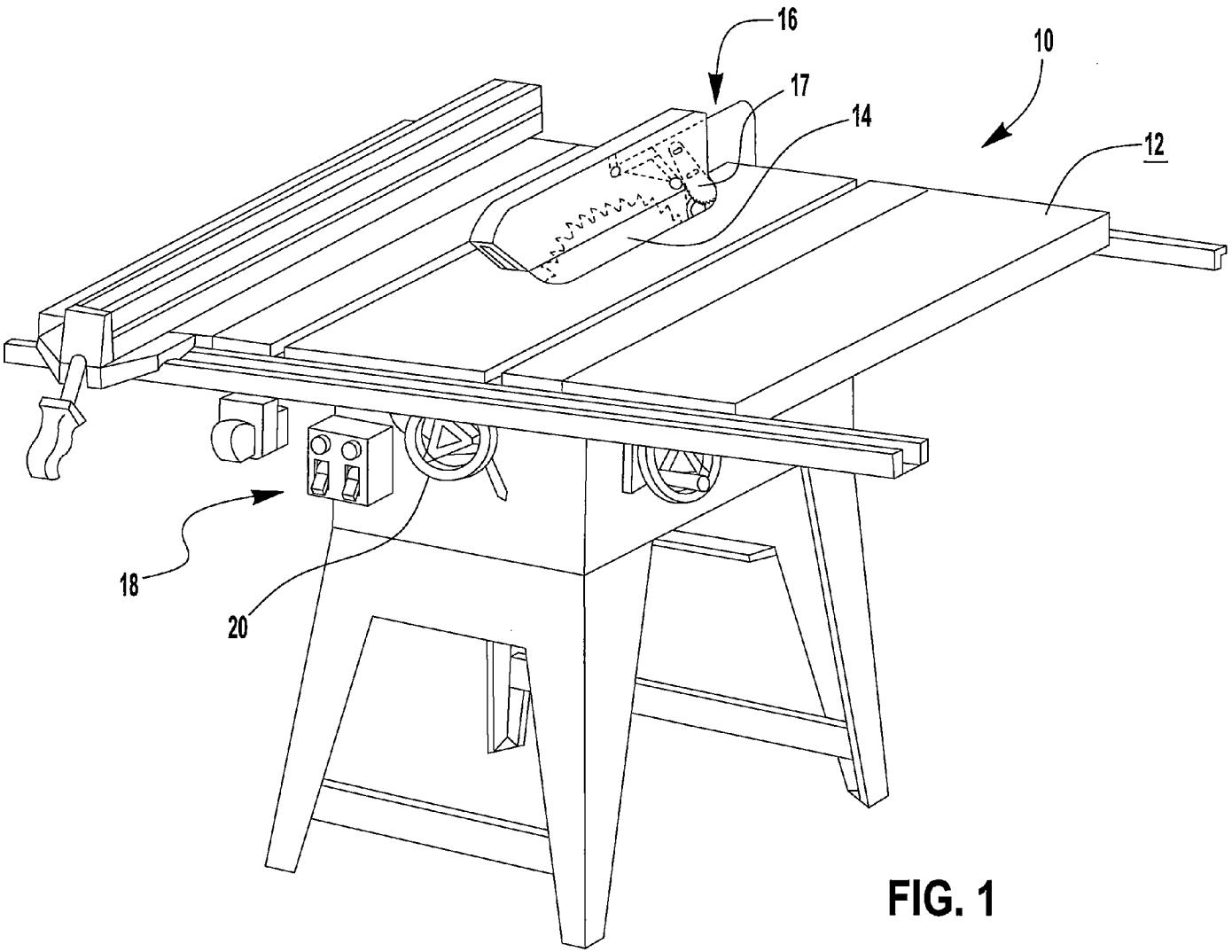
FIG. 1 is a perspective view of a saw having a saw accessory and a control panel for controlling a saw accessory clamp in accordance with one non-limiting embodiment of the present invention.
Figure 2:
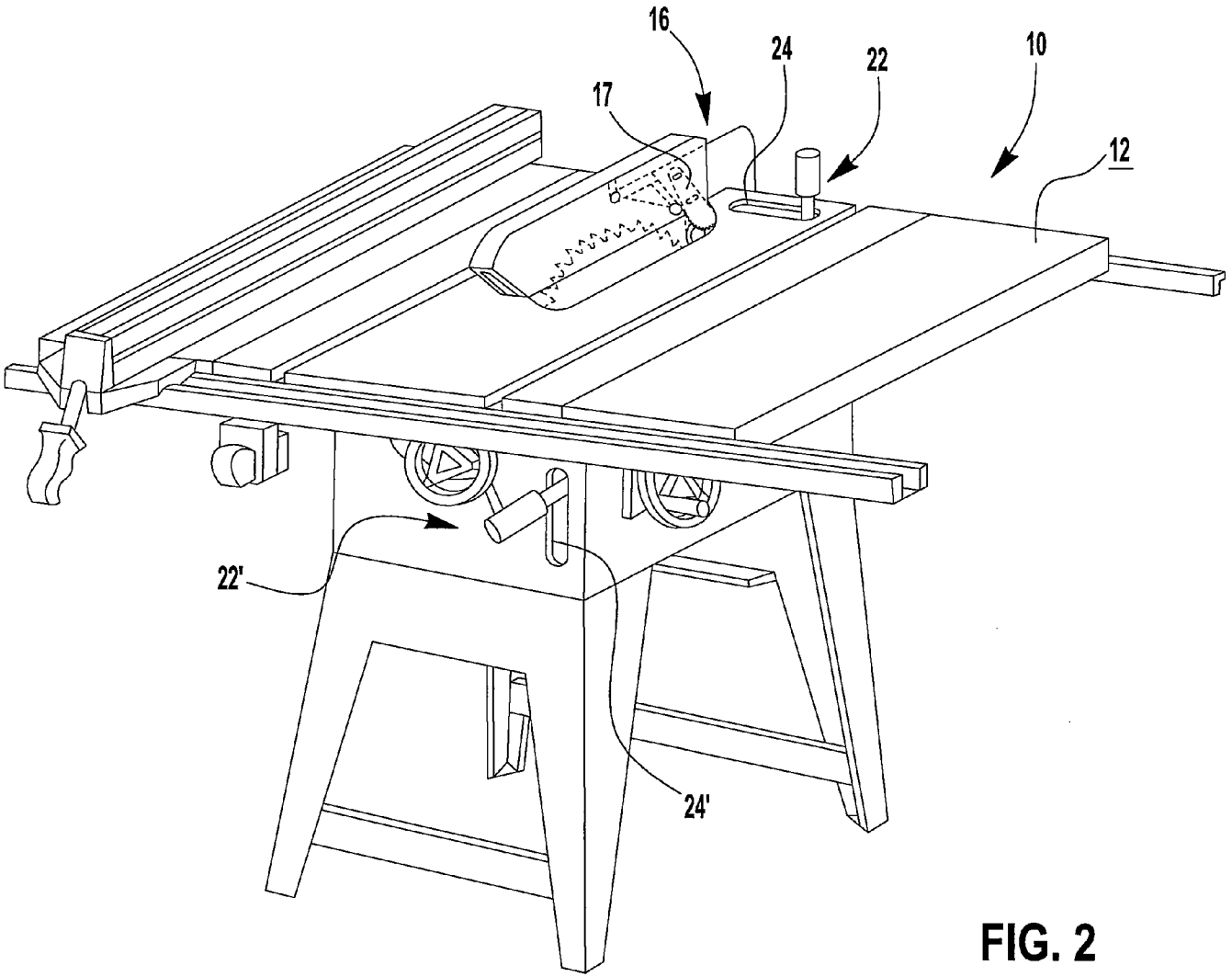
FIG. 2 is a perspective view of a saw having a saw accessory and a lever clamp actuator for controlling a saw accessory clamp in accordance with one non-limiting embodiment of the present invention.
Figure 3:
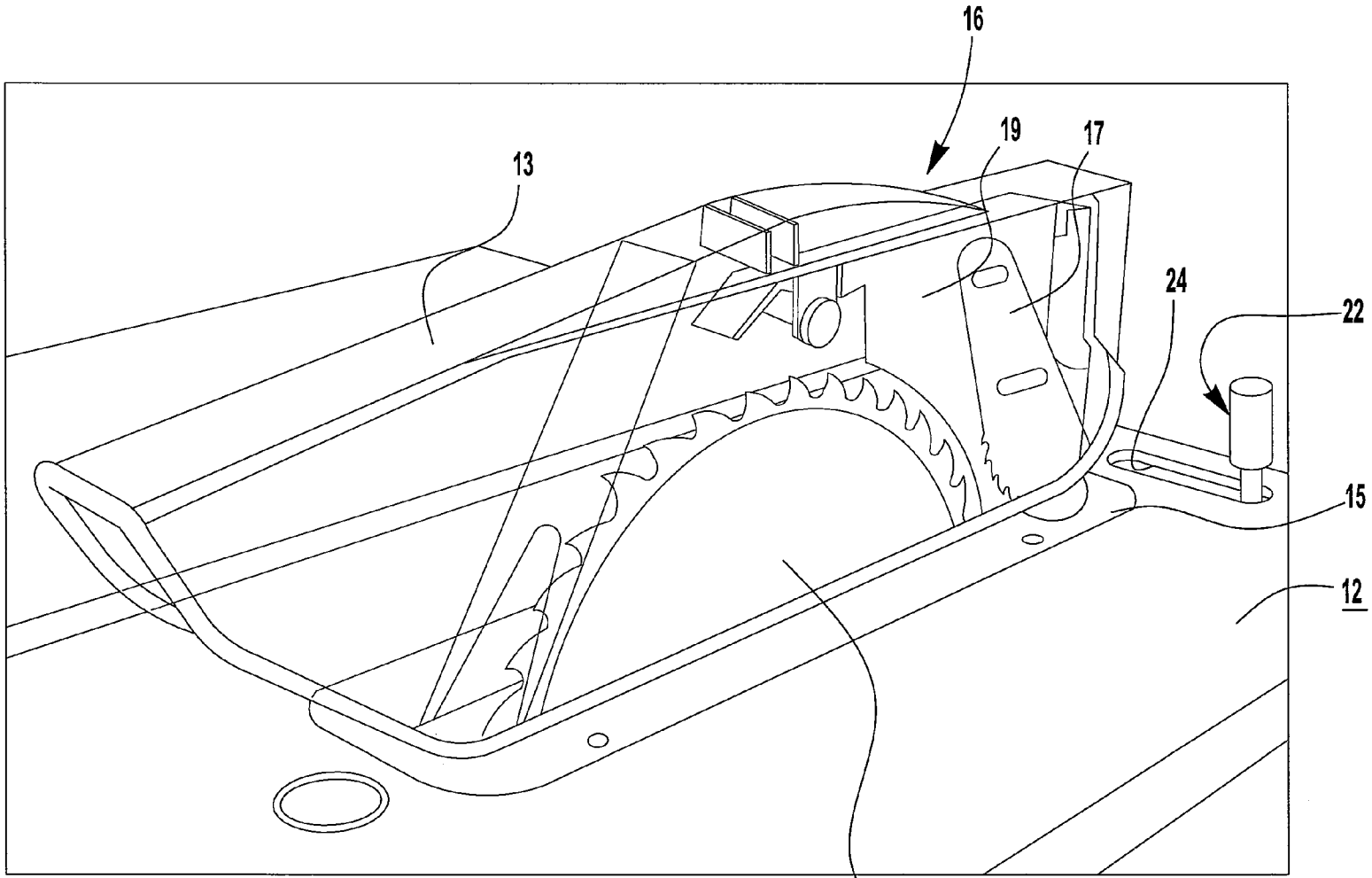
FIG. 3 is a perspective view of the saw accessory and the lever clamp actuator of FIG. 2.
Figure 4:
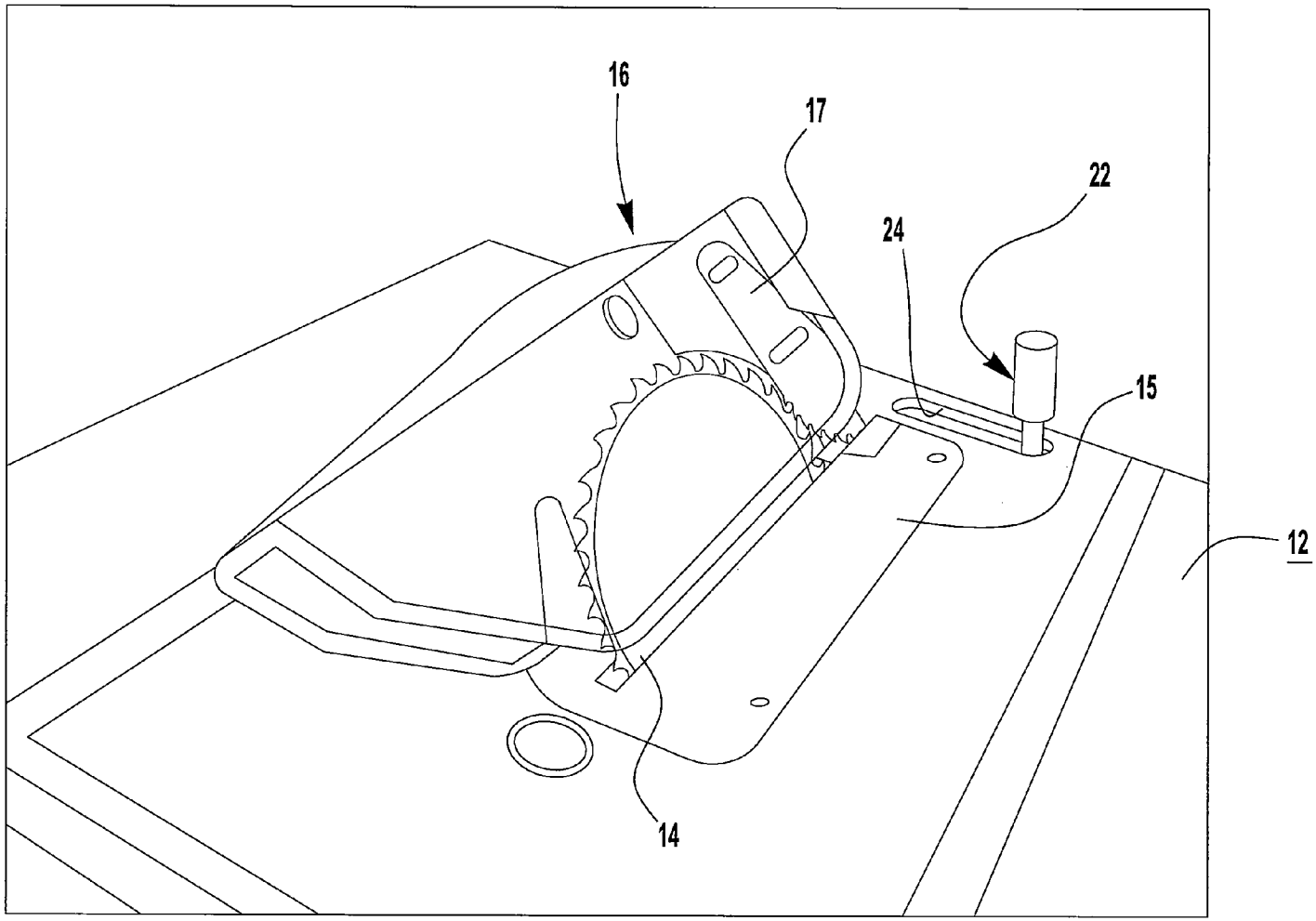
FIG. 4 is a perspective view of the saw accessory and the lever clamp actuator of FIG. 2 with a blade and the saw accessory in a tilted configuration.

In various embodiments, referring to FIGS. 1-4, saw 10 can include working surface 12, blade 14, and saw accessory 16, wherein saw 10 can be configured to cut wood, plastic, and/or other materials. In at least one embodiment, saw accessory 16 can include riving knife 19, blade guard 13, and/or anti-kick-back pawls 17, for example. In various embodiments, saw 10 can include an arbor assembly (not illustrated) for rotating blade 14 wherein the arbor assembly can include a motor configured to rotate blade 14 in a suitable direction. In at least one embodiment, blade 14 can be configured to extend through a slot in throat plate 15, where throat plate 15 can be situated on and positioned substantially flush with working surface 12 (FIGS. 3 and 4). In various embodiments, the arbor assembly, and blade 14, can be raised and lowered with respect to working surface 12 through the use of hand-screw 20. In at least one embodiment, the arbor assembly and blade 14 can pivot with respect to working surface 12 for producing bevel cuts, for example. Such pivoting can be accomplished through the use of hand-screw 21.

In various embodiments, an accessory slot (not illustrated) can be provided in the working surface of the saw such that the saw accessory, such as a blade guard or riving knife, for example, can slide from a position proximate to the blade to a position remote from the blade. In at least one embodiment, the operator can slide the saw accessory to the position remote from the blade to adjust and/or change out the accessory and then simply slide the accessory back into the proximate position. In at least one various embodiment, a lock (not illustrated) can be provided within the slot to retain the saw accessory in the position remote from the blade while the accessory is adjusted and/or changed out by the operator. In various embodiments, the slidable saw accessory may be more convenient and less time-consuming for the operator to use when compared to a traditional saw accessory.

Figure 5:
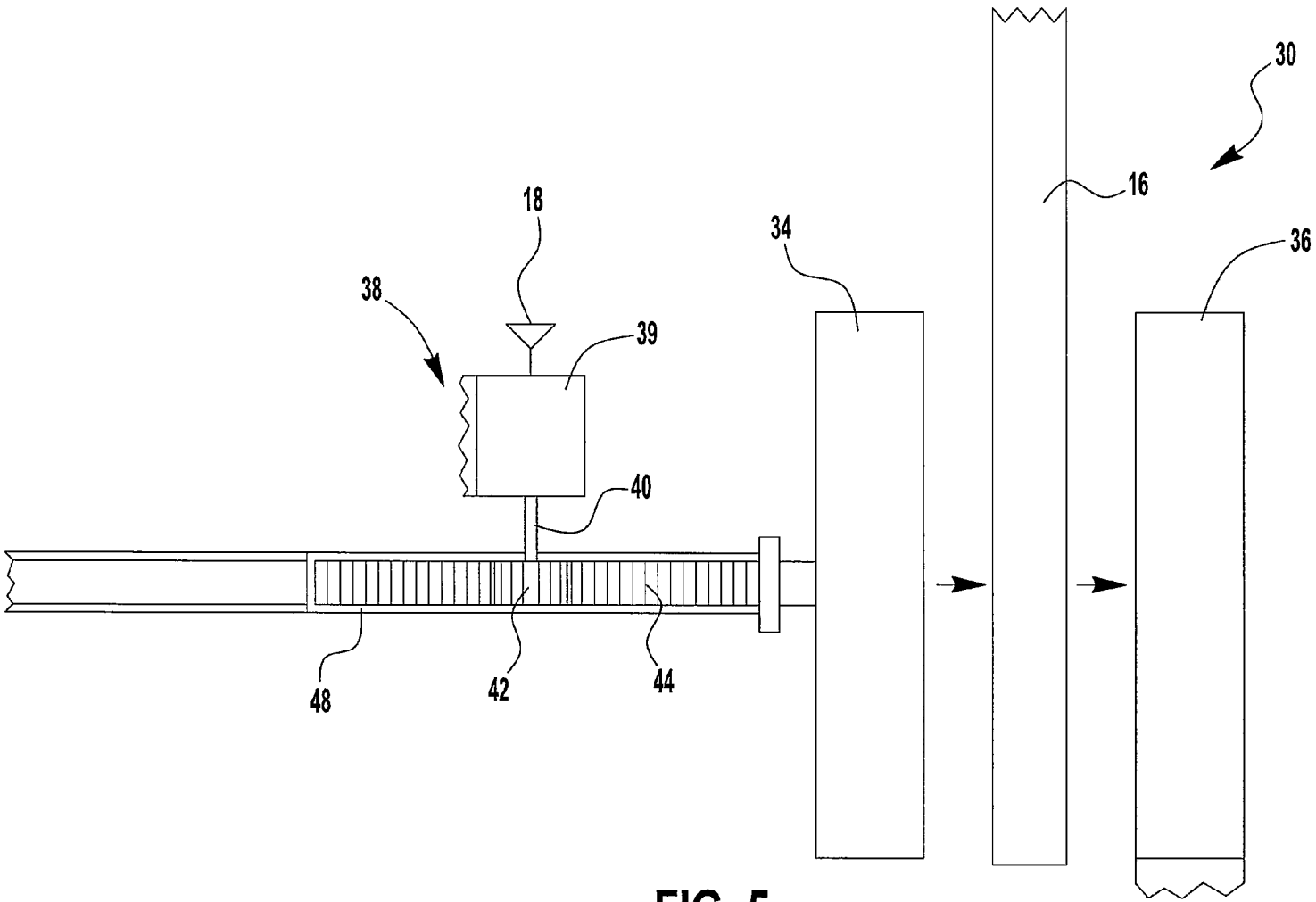
FIG. 5 is an elevational view of a clamp for a saw accessory in an open position and an electrical actuator in accordance with one non-limiting embodiment of the present invention.
Figure 6:
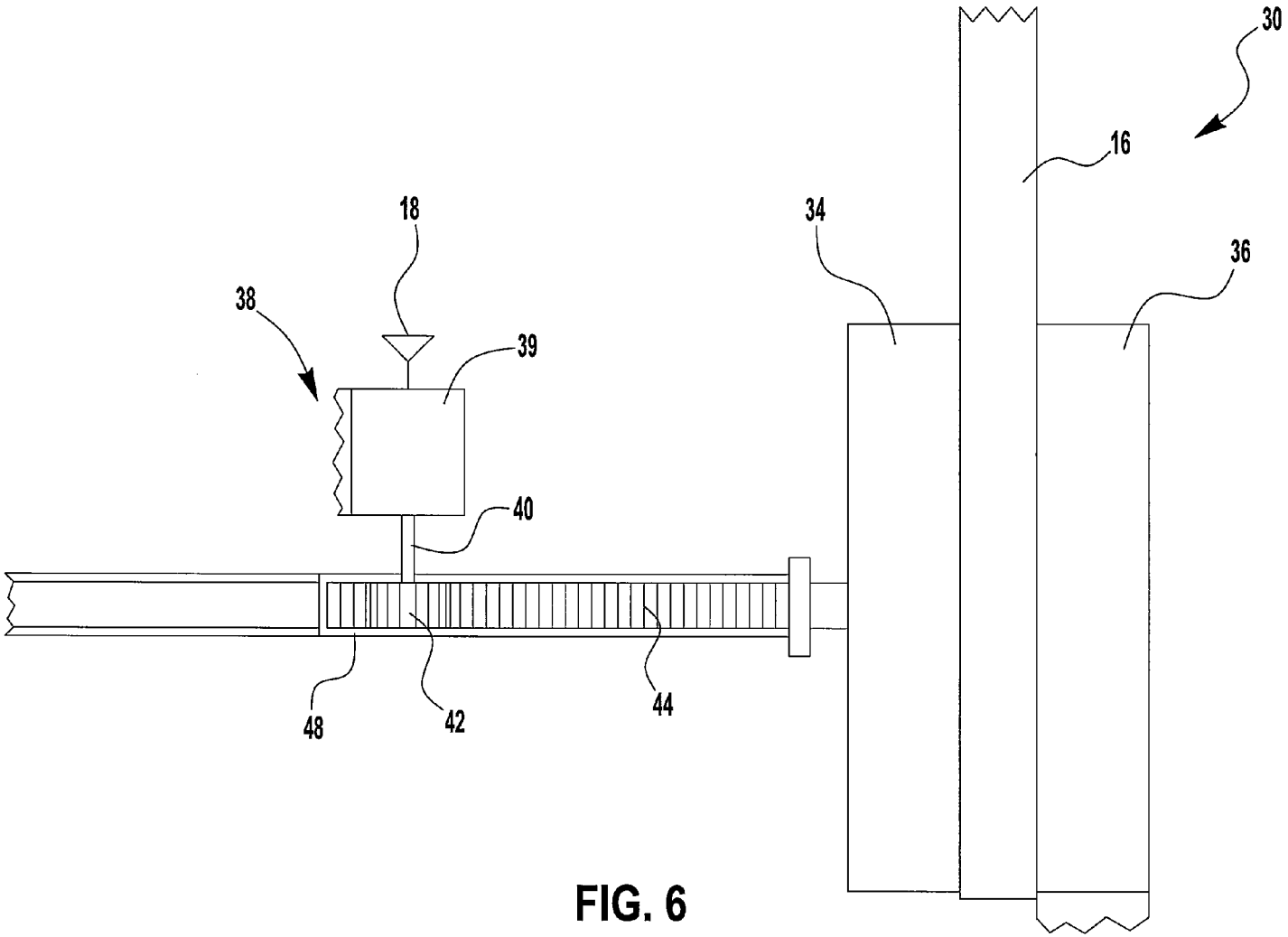
FIG. 6 is an elevational view of the clamp of FIG. 5 in a closed position.

In various embodiments, referring to FIGS. 5 and 6, clamp assembly 30 can be configured to attach saw accessory 16 to saw 10 where clamp assembly 30 can include first jaw member 34 and second jaw member 36. In at least one embodiment, first jaw member 34 can be moved relative to second jaw member 36 to clamp saw accessory 16 therebetween. More particularly, first jaw member 34 can be moved between an open, or disengaged, position, as illustrated in FIG. 5, and a closed, or engaged, position as illustrated in FIG. 6. In at least one such embodiment, second jaw member 36 may be fixedly mounted to saw 10. In various embodiments, first jaw member 34 may be fixedly mounted to saw 10 and second jaw member 36 may be movable relative to first jaw member 34. In other various embodiments, both first and second jaw members 34 and 36 can be movable relative to each other.

In various embodiments, clamp assembly 30 can further include, first, at least one actuator for moving, or motivating, at least one of jaw members 34 and 36 as described above and, second, at least one controller for activating the actuator. In at least one embodiment, the actuator can include an electrical actuator, such as a motor and/or a solenoid, for example. In various embodiments, the actuator can include a fluid actuator, such as a hydraulic or pneumatic cylinder, for example. In any event, the controller can be in communication, either mechanically, electrically, and/or fluidly, with the actuator such that the actuator can be activated by the controller. In various embodiments, the clamp and the actuator can be positioned underneath work surface 12 of saw 10 and the controller can be mounted to saw 10 such that the operator can easily manipulate the controller without having to position their hand near blade 14, for example, contrary to the previous devices described above.

Further to the above, referring to FIGS. 5 and 6, clamp assembly 30 can further include actuator 38 and controller 18. In at least one embodiment, actuator 38 can be configured to move at least one of first jaw member 34 and second jaw member 36 as outlined above. In various embodiments, actuator 38 can include motor 39, or any other suitable motivating device, wherein motor 39 can be mounted to saw 10. In at least one embodiment, as discussed above, saw 10 can include an arbor for rotating blade 14 wherein clamp assembly 30 can be mounted to the arbor such that, when the arbor is tilted as illustrated in FIG. 4, clamp assembly 30 can be tilted along with the arbor. In at least such embodiments, saw accessory 16 can remain aligned with saw blade 14. In at least one embodiment, clamp assembly 30 can include two or more actuators wherein at least one actuator can be operably engaged with each jaw member 34 and 36. In either event, in various embodiments, the operator can release saw accessory 16 positioned within clamp assembly 30 by operating controller 18 from a location remote from blade 14. The operator can then grab saw accessory 16, remove it from clamp assembly 30, and, if they so chose, position another saw accessory 16 in clamp assembly 30 and then close clamp accessory 30 via controller 18 without having to position their hand adjacent blade 14.

In various embodiments, referring to FIGS. 5 and 6, actuator 38 can include a rack and pinion assembly configured to move at least one jaw member relative to the other. In at least one embodiment, actuator 38 can include rotatable drive shaft 40, gear 42, and rack 44. Gear 42 can be mounted to drive shaft 40 such that, when drive shaft 40 is rotated by motor 39, for example, drive shaft 40 can rotate gear 42 in a suitable direction. In various embodiments, gear 42 can include one or more teeth extending therefrom wherein the teeth can be configured to engage recesses in rack 44. In other various embodiments, although not illustrated, gear 42 can include one or more recesses which can be configured to engage one or more teeth extending from rack 44. In either event, gear 42 can be configured to drive, or translate, rack 44 along a predetermined path including a straight line, for example. In various embodiments, first jaw member 34 can be mounted to, or otherwise operably engaged with, rack 44 such that jaw member 34 can be driven toward second jaw member 36 when rack 44 is driven by gear 42 as described above. In at least one embodiment, clamp assembly 30 can further include track 48 which can be configured to define a path for rack 44 to allow rack 44 to be slid relative to first jaw member 34.

Once first jaw member 34 has been positioned against saw accessory 16 by rack 44 as described above, first jaw member 34 can move, or position, accessory 16 against second jaw member 36. Thereafter, actuator 38 can apply a clamping force to saw accessory 16 via first jaw member 34 such that accessory 16 can be held securely in place between jaw members 34 and 36. In at least one embodiment, at least one of jaw members 34 and 36 can include ridges and/or a rough surface to increase the force required to remove saw accessory 16 from jaw members 34 and 36 when accessory 16 is held therebetween. More particularly, the ridges and/or rough surfaces can increase the coefficient of friction between the jaw members 34 and 36 and saw accessory 16 and can, as a result, increase the resistance, or frictional force, holding accessory 16 in position. In various embodiments, adjustments to the compressive force applied to accessory 16 can also affect the frictional force. Stated another way, as the frictional force is proportional to the coefficient friction and the normal, or compressive, force applied to the surface of accessory 16, the frictional force between jaw members 34 and 36 and saw accessory 16 can increase with an increase in compressive force. In various embodiments, once a sufficient clamping, or compressive, force has been applied to saw accessory 16, clamp assembly 30 and/or actuator 38, for example, can be locked into position such that the movement of jaw members 34 and 36 can be prevented, or at least substantially inhibited.

In various embodiments, as outlined above, saw 10 can further include a controller configured to activate actuator 38. In at least one embodiment, referring to FIG. 1, controller 18 can be mounted to saw 10 such that an operator can easily access and operate controller 18 without having to position their hand, for example, near blade 14. In at least one such embodiment, controller 18 can be positioned beneath work surface 12 of saw 10. In various embodiments, controller 18 can include at least one button or switch, for example, which can place controller 18 and actuator 38 in electrical communication, for example. In at least one embodiment, the button and/or switch can be manipulated by the operator to close an electrical circuit and operatively connect motor 39 and a power source such that first jaw member 34 can be moved into its closed position by motor 39 as described above. In other various embodiments, although not illustrated, the actuator can include a solenoid wherein the solenoid can be placed in electrical communication with a power source by the controller. In at least one such an embodiment, the solenoid can include a rotatable shaft and a cam mounted to the shaft such that, when the shaft is rotated by an electrical field created by windings within the solenoid, the shaft can rotate the cam and move first jaw member between open and closed positions, for example. In various embodiments, further to the above, clamp assembly 30 can include a force limiting module which can regulate the flow of current to motor 39 and/or the solenoid, for example, once a desired clamping force to saw accessory 16 has been reached.

In at least one embodiment, controller 18 and actuator 38 can be in electrical communication via a plurality of wires, for example. In other various embodiments, controller 18 and actuator 38 can be in communication with each other via a wireless signal transmission system. More particularly, controller 18 and actuator 38 can each include at least one of a wireless transmitter and receiver where, in at least one embodiment, the transmitters and receivers can be configured to relay information to each other across one or more transmission signals. In such embodiments, as a result, controller 18 can be placed in any suitable position on saw 10 without regard to the position of actuator 38. In various embodiments, in order to release, or open, clamp assembly 30, for example, the operator can depress or release a button and/or switch, for example, on controller 18 which can cause controller 18 to send a signal to actuator 38, via wires and/or a wireless transmission, which can cause actuator 38 to deactivate motor 39, for example, and/or move first jaw member 34 relative to second jaw member 36. In at least one embodiment, actuator 38 can rotate drive shaft 40 in an opposite direction such that gear 42 can translate rack 44 in an opposite direction as well.

Figure 7:
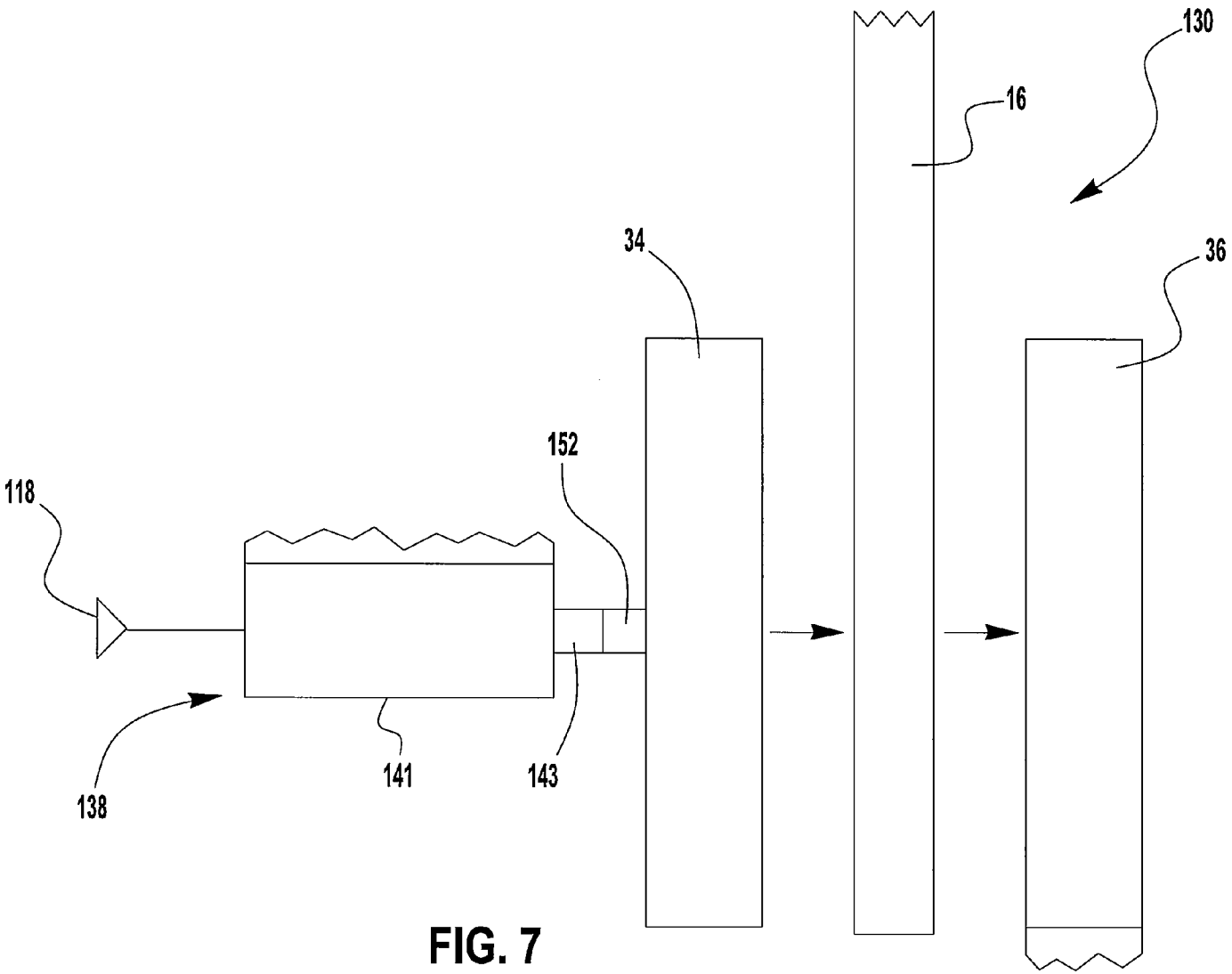
FIG. 7 is an elevational view of a clamp for a saw accessory in an open position and a fluid actuator in accordance with another non-limiting embodiment of the present invention.
Figure 8:
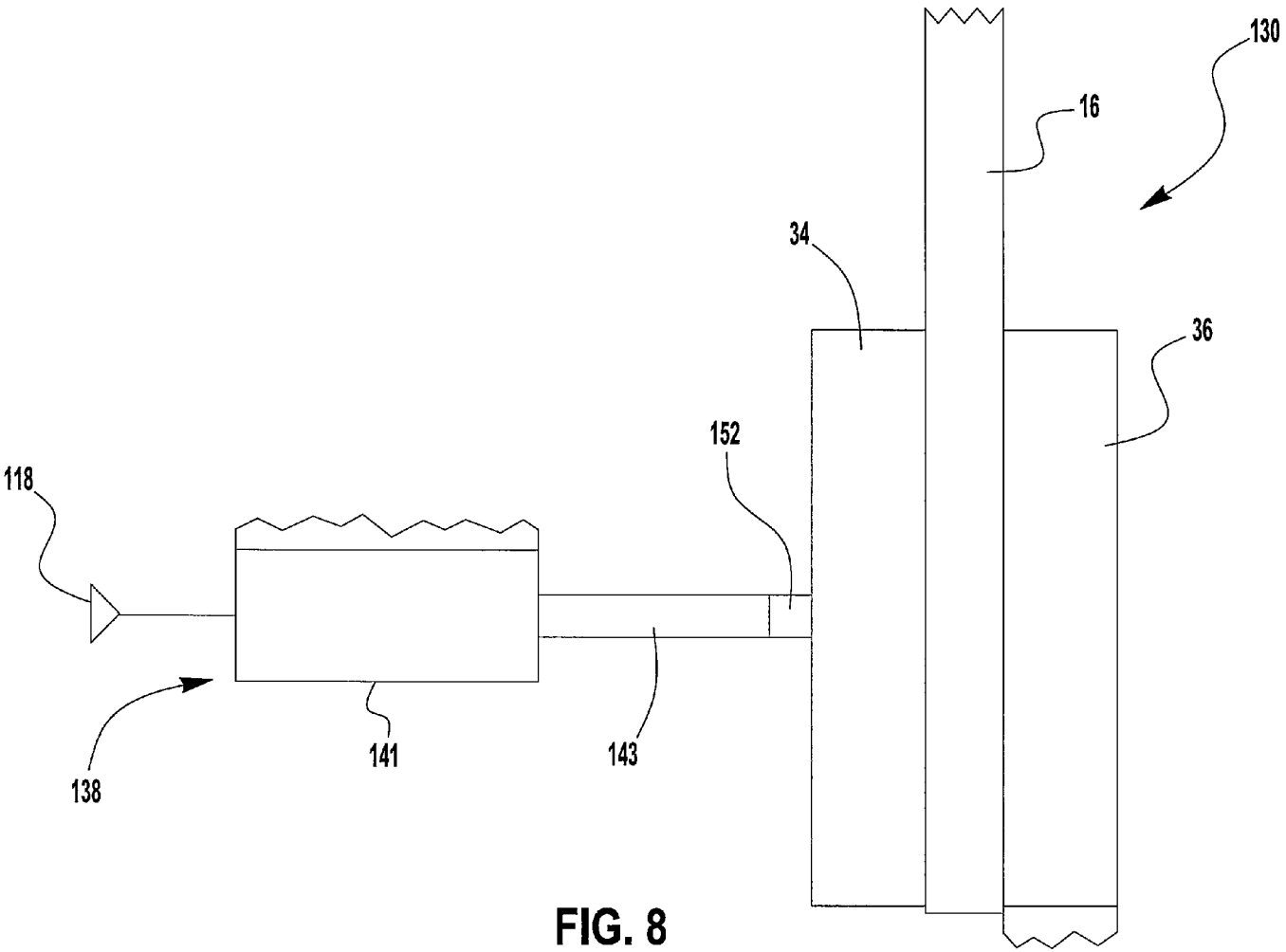
FIG. 8 is an elevational view of the clamp of FIG. 7 in a closed position.

In various embodiments, referring to FIGS. 7 and 8, a clamp assembly can include an actuator which is operated by a fluid. In at least one embodiment, the actuator can include a hydraulic and/or pneumatic cylinder which can move at least one of clamping members 34 and 36 relative to each other as described above. In various embodiments, clamping assembly 130 can include actuator 138, wherein actuator 138 can include housing 141 and piston 143. In at least one various embodiment, piston 143 can be sealingly engaged with and be movable relative to housing 141 such that piston 143 and housing 141 can define a sealed chamber therebetween (not illustrated). In order to move piston 143 relative to housing 141, a fluid, such as hydraulic fluid or air, for example, can be introduced into or evacuated from the chamber in order to increase and/or decrease a fluid force acting on piston 143. In various embodiments, at least one of clamping members 34 and 36 can be mounted to, or in contact with, extension rod 152 extending from piston 143 such that, when piston 143 is moved relative to housing 141 by the fluid, clamping member 34 can be moved relative to clamping member 36, for example, between an open (FIG. 7) and a closed (FIG. 8) position. In various embodiments, clamp assembly 130 can further include controller 118 which can include, or be in communication with, a fluid pump (not illustrated) configured to push fluid into and/or withdraw fluid from the chamber in actuator 138. In various embodiments, controller 118 and/or the fluid pump can be conveniently positioned near the operator and the assembly can further include fluid lines, or conduits, which can place the pump and/or controller 118 in fluid communication with actuator 138. In at least such embodiments, as a result, an operator does not have to position themselves near the saw blade to open and close the saw accessory clamp.

Figure 9:
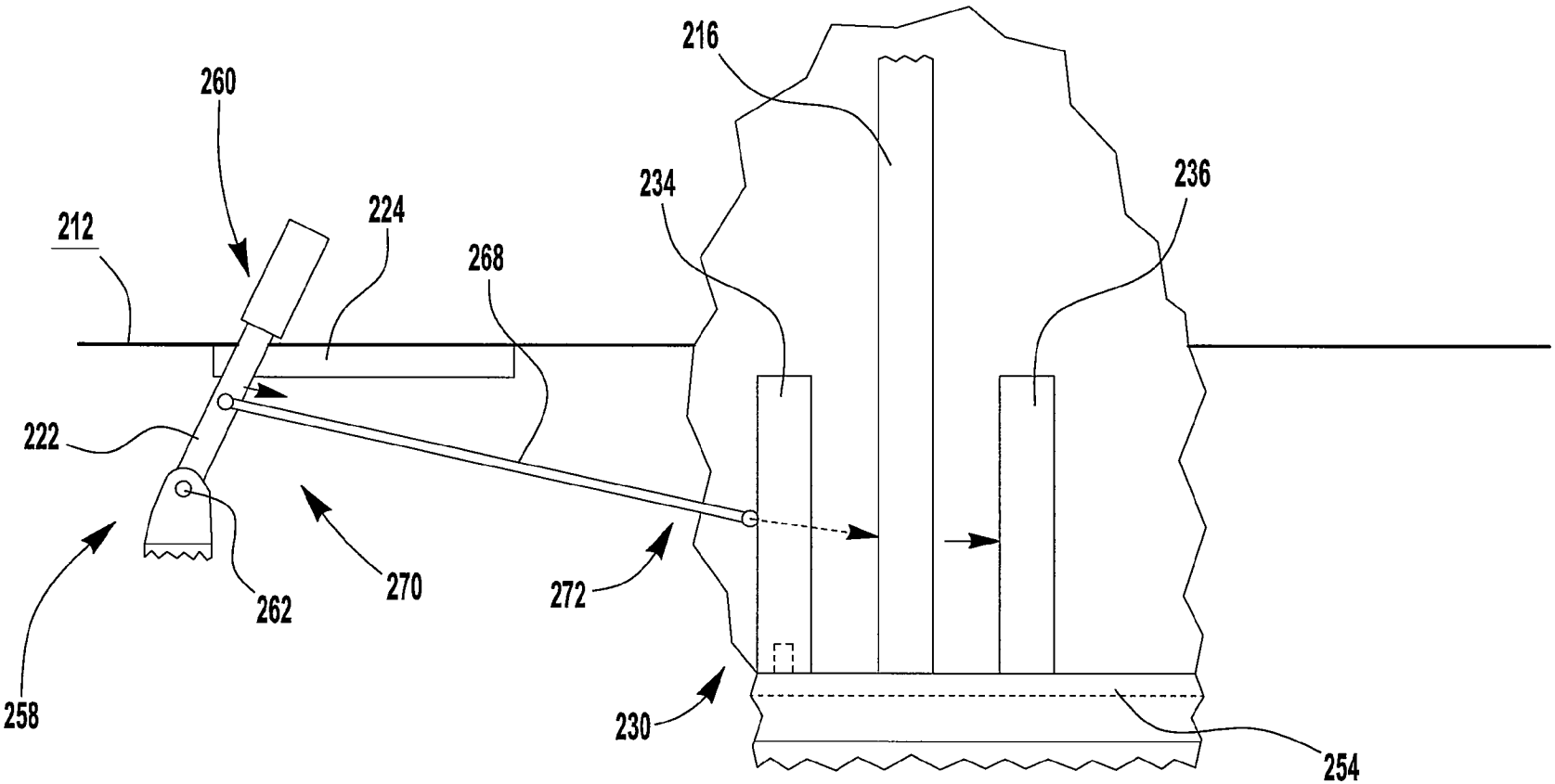
FIG. 9 is an elevational view of a clamp for a saw accessory in an open position and a lever actuator in accordance with another non-limiting embodiment of the present invention.
Figure 10:
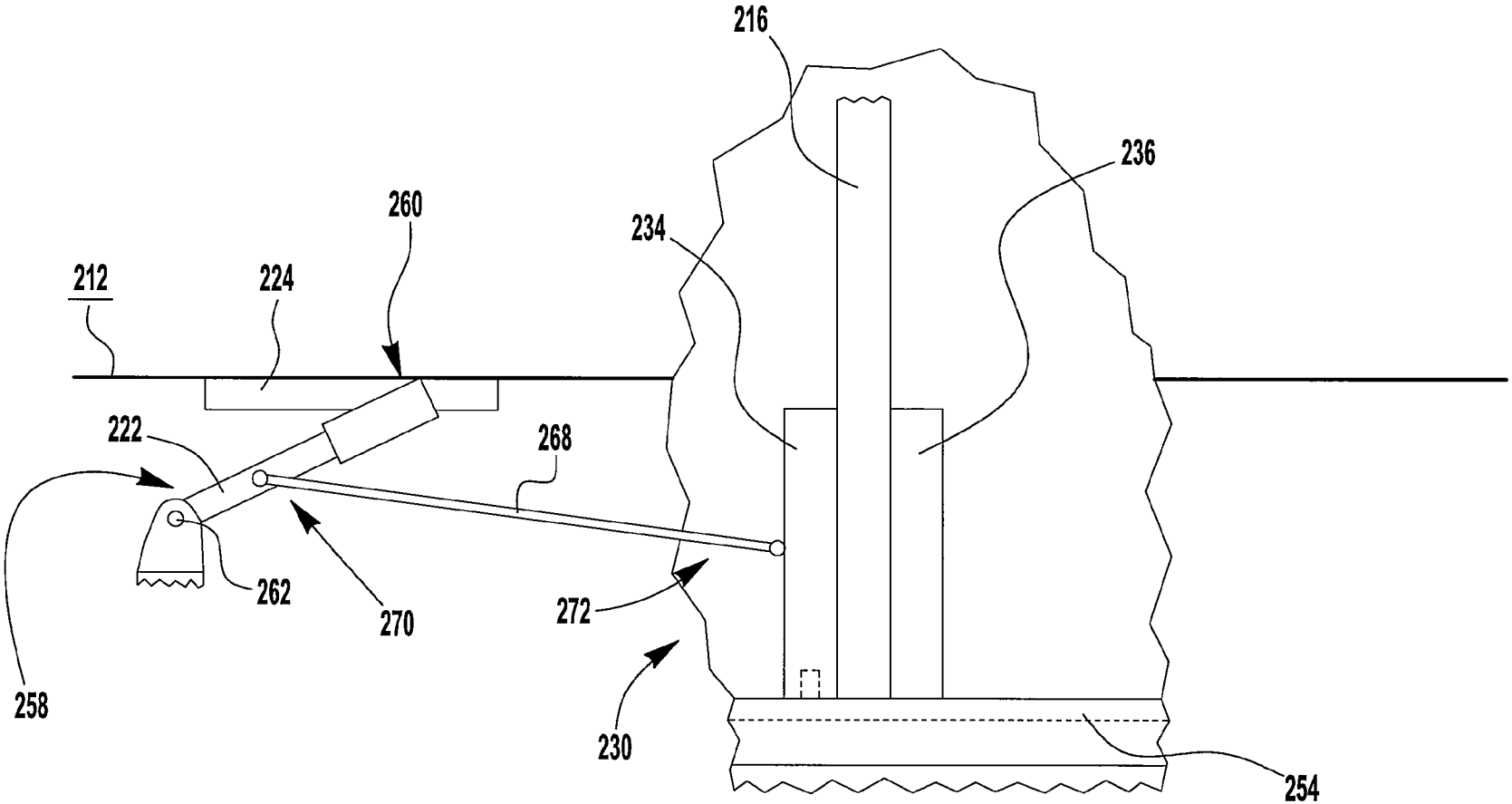
FIG. 10 is an elevational view of the clamp of FIG. 9 in a closed position.

In various embodiments, referring to FIGS. 2, 9, and 10, a clamp assembly can include at least one jaw member which can be moved relative to another jaw member via a lever and a connecting link. In at least one embodiment, clamp assembly 230 can include lever 222 which can be operatively engaged with at least one of first jaw member 234 and second jaw member 236 in order to open and close clamp assembly 230 similar to the above. In various embodiments, lever 222 can be situated in working surface 212 or in a side wall of saw 10. Similarly, saw 10 could include levers 22 and/or 22' (FIGS. 2-4), for example, wherein lever 22 can extend through a working surface of the saw and can be collapsible or otherwise manipulated to be positioned beneath the working surface. In any event, in various embodiments, lever 222 can include first end 258 and second end 260, where first end 258 can be rotatably and/or pivotably mounted to saw 10 at pivot 262. In at least one embodiment, first end 258 and pivot 262 can be positioned below working surface 212 and second end 260 can extend through slot 224 in working surface 212 or in any other suitable location which is accessible to the operator. In at least one embodiment, clamp assembly 230 can further include connecting link 268 rotatably or pivotably mounted to lever 222 at first end 270 and, similarly, to first jaw member 234 at second end 272 such that, when lever 222 is rotated within slot 224, connecting link 268 and first jaw member 234 are displaced by lever 222 to clamp accessory 216 in position.

In various embodiments, as outlined above, in order to open and/or close clamp 230, second end 260 of lever 222 can be rotated toward and/or away from the operator within slot 224, for example. In at least one embodiment, second end 260 of lever 222 can be positioned substantially flush with or below work surface 212 when lever 222 has been rotated to place first clamping member 234 in its closed position. In various embodiments, slot 224 can include a clamp lock member (not illustrated) which can be configured to hold lever 222 in a portion of slot 224 when clamp 230 is engaged. In at least one such embodiment, the operator may be required to apply a sufficient force to lever 222 in order to overcome the retaining force of the lock member.

Figure 11:
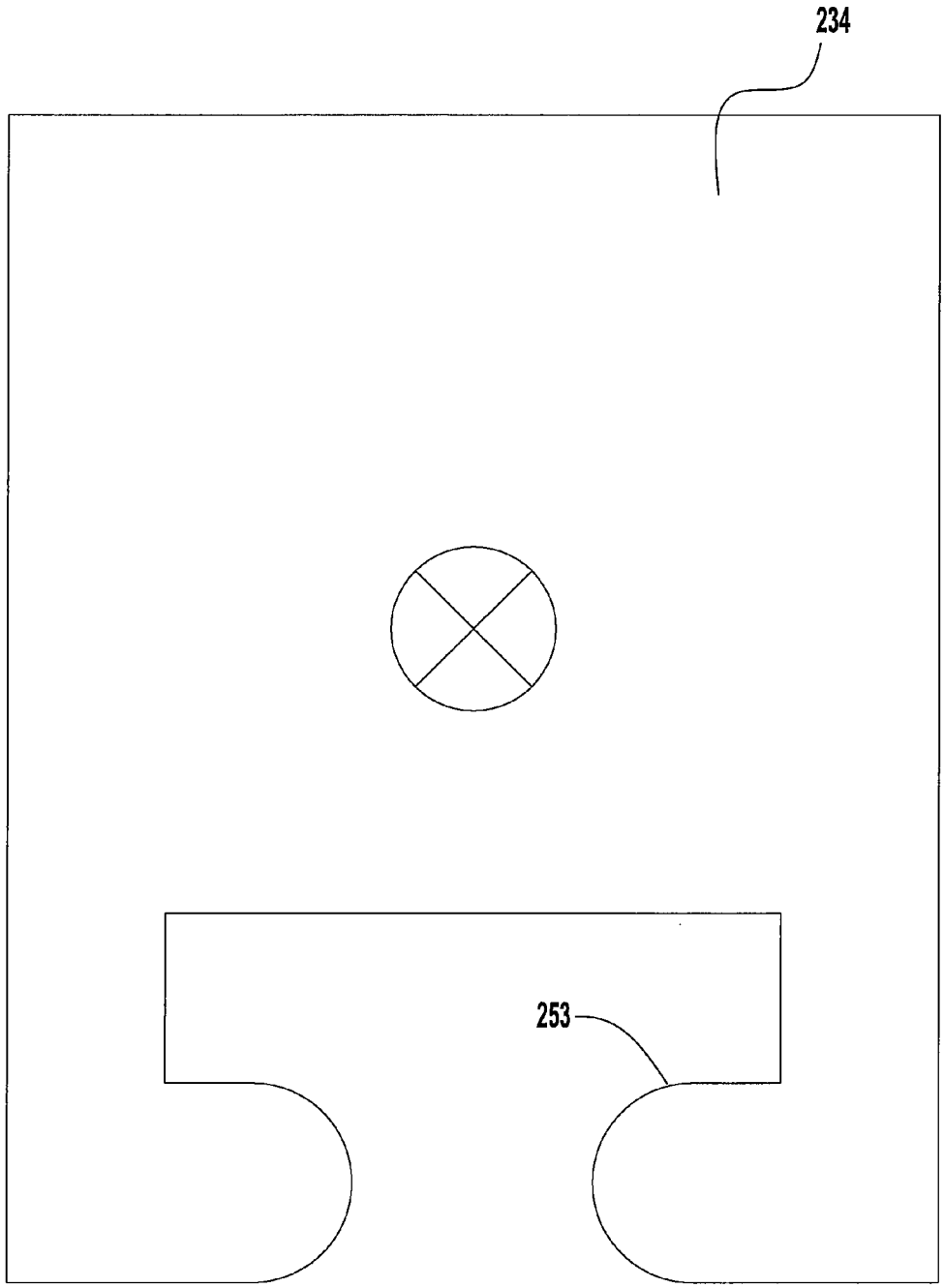
FIG. 11 is an elevational view of a clamping member of the clamp of FIG. 9.

In various embodiments, referring to FIGS. 9-11, clamp assembly 230 can further include track 254 and, in addition, clamping member 234 and/or 236 can further include groove 253 wherein track 254 and groove 253 can cooperate to define a path for first member 234 and/or second member 236, for example. In at least one embodiment, track 254 can include a T-rail portion extending therefrom which can be received with a T-shaped portion of groove 253 such that relative movement between first jaw member 234 and track 254 can be substantially limited to a path defined by track 254. In various embodiments, track 254 can define a curved, linear, and/or curvi-linear path, for example, for at least one of the jaw members.

In various embodiments, a clamp assembly can include a biasing member, such as a spring, for example, which can be configured to bias the clamp assembly into either an open or closed position. In at least one embodiment, referring to FIGS. 12 and 13, clamp assembly 330 can include lever 322, connection member 380, and at least one movable jaw member, such as first jaw member 334. In at least such embodiments, connection member 380 can include a cable and/or link, wherein connection member 380 can be operably connected to lever 322 and jaw member 334 such that the rotation of lever 322 can pull first jaw member 334 into an open position. In at least one such embodiment, clamp assembly 330 can further include coil spring 384 positioned intermediate first jaw member 334 and fixed portion 386 of saw 10, such as a portion of the arbor, for example. In various embodiments, spring 384 can be configured to bias first jaw member 334 into a closed position such that, when first jaw member 334 is moved into its open position, spring 384 can be compressed by first jaw member 334 and, after lever 322 has been released, spring 384 can release the potential energy stored therein and move first jaw member 334 into a closed position and clamp accessory 316 against jaw member 336. In various embodiments, clamp assembly 330 can further include at least one locking member which can hold lever 322 in at least one of an open and closed position, for example. In at least such embodiments, the locking member can hold lever 322 in place while the operator removes the saw accessory from, or adjusts the saw accessory within clamp assembly 330. Thereafter, the operator can release the locking member and allow spring 384 to return lever 322 to its starting position and move handle 361 into slot 324 within surface 312, for example.

Figure 12:
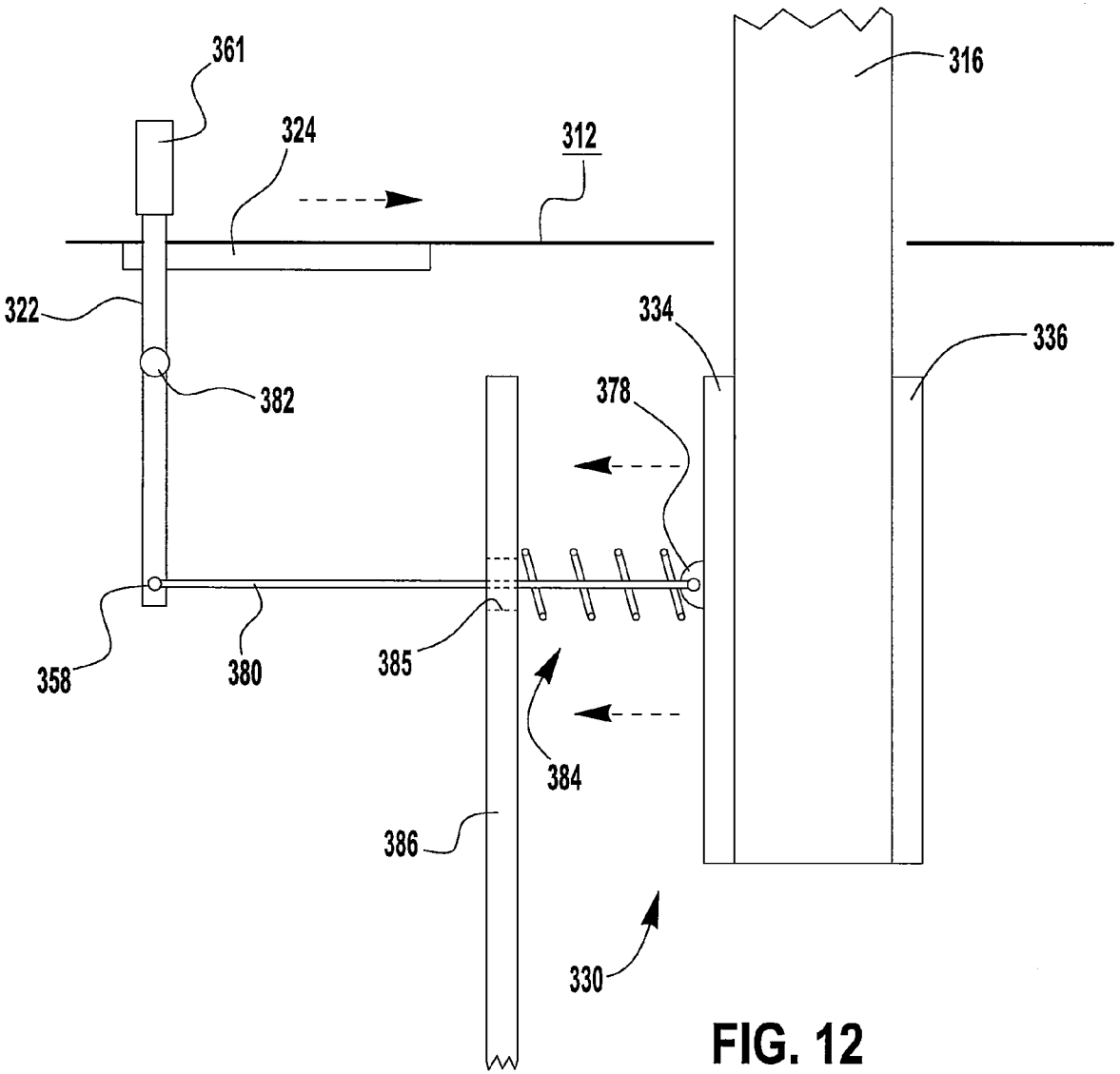
FIG. 12 is an elevational view of a clamp for a saw accessory in a closed position in accordance with another non-limiting embodiment of the present invention.
Figure 13:
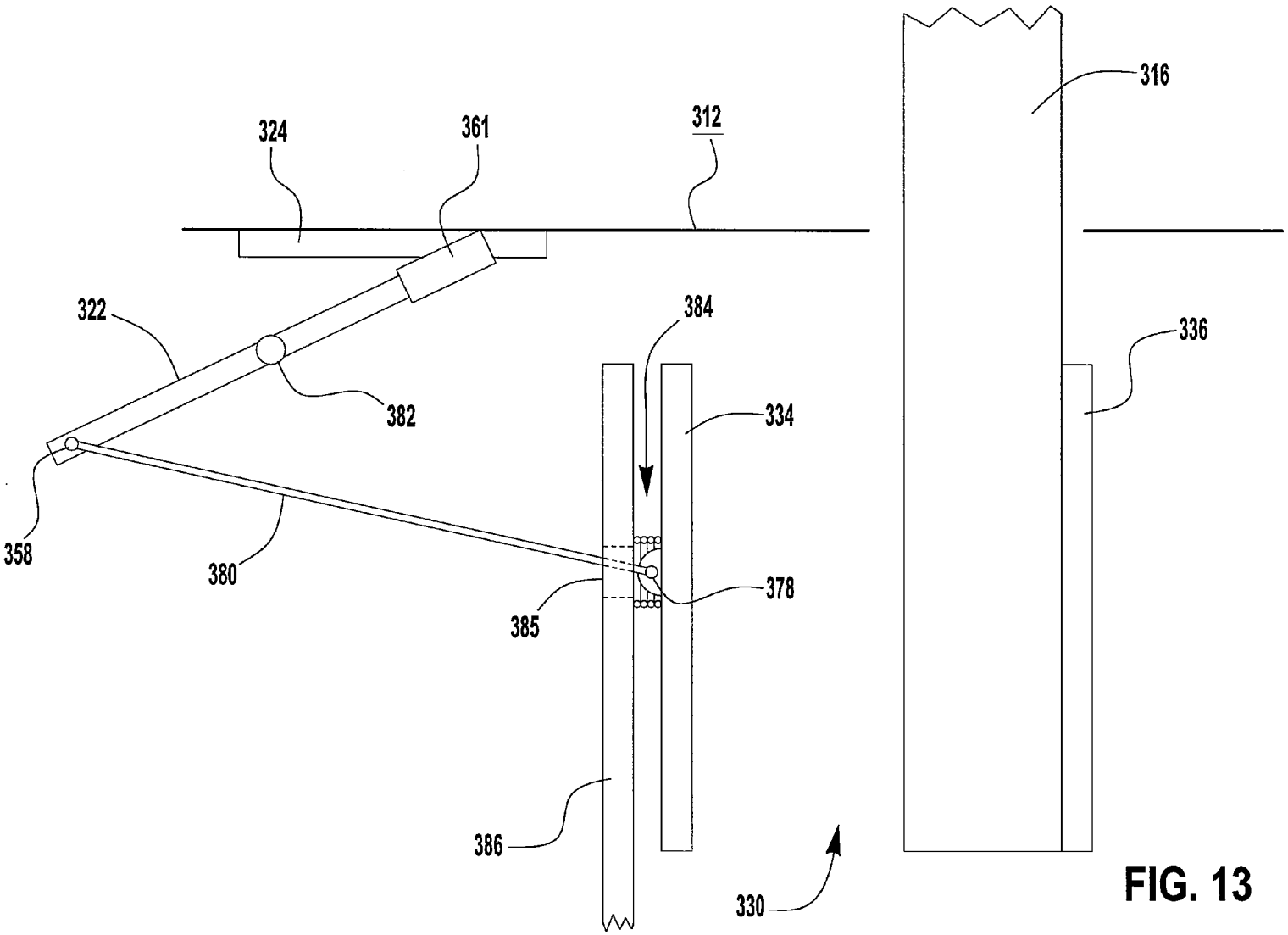
FIG. 13 is an elevational view of the clamp of FIG. 12 in an open position.

Further to the above, in at least one embodiment, first jaw member 334 can have at least one cable attachment mount 378 located thereon which can be situated centrally on jaw member 334 such that cable 380 does not apply an undesired torque, or moment, to first jaw member 334 and cause jaw member 334 to rock and bind on a guide track, for example. In at least one embodiment, cable 380 can be positioned axially through compression spring 384 and, in various embodiments, cable 380 can be routed through aperture 385 in fixed portion 386. In various embodiments, a middle portion of lever 322 can be rotatably or pivotably mounted to saw 10 by pin 382 and, as illustrated in FIG. 12, cable or link 380 can be mounted to lever 322 at attachment point 358. In at least one embodiment, the distance between handle 361 and pin 382 and, in addition, the distance between pin 382 and attachment point 358, can be selected to provide the operator with a mechanical advantage to compress spring 384 and move first jaw member 334 as described above. More particularly, the ratio of these distances can be selected such that the force that the operator needs to apply to lever 322 to open first jaw member 334 can be less than the force required to actually compress spring 384. In other various embodiments, a clamp assembly can include any other suitable spring and/or two or more compression springs 384. In at least such embodiments, springs 384 can be positioned relative to first jaw member 334 such that springs 384 apply a balanced, or at least substantially balanced, torque to first jaw member 334.

Figure 14:
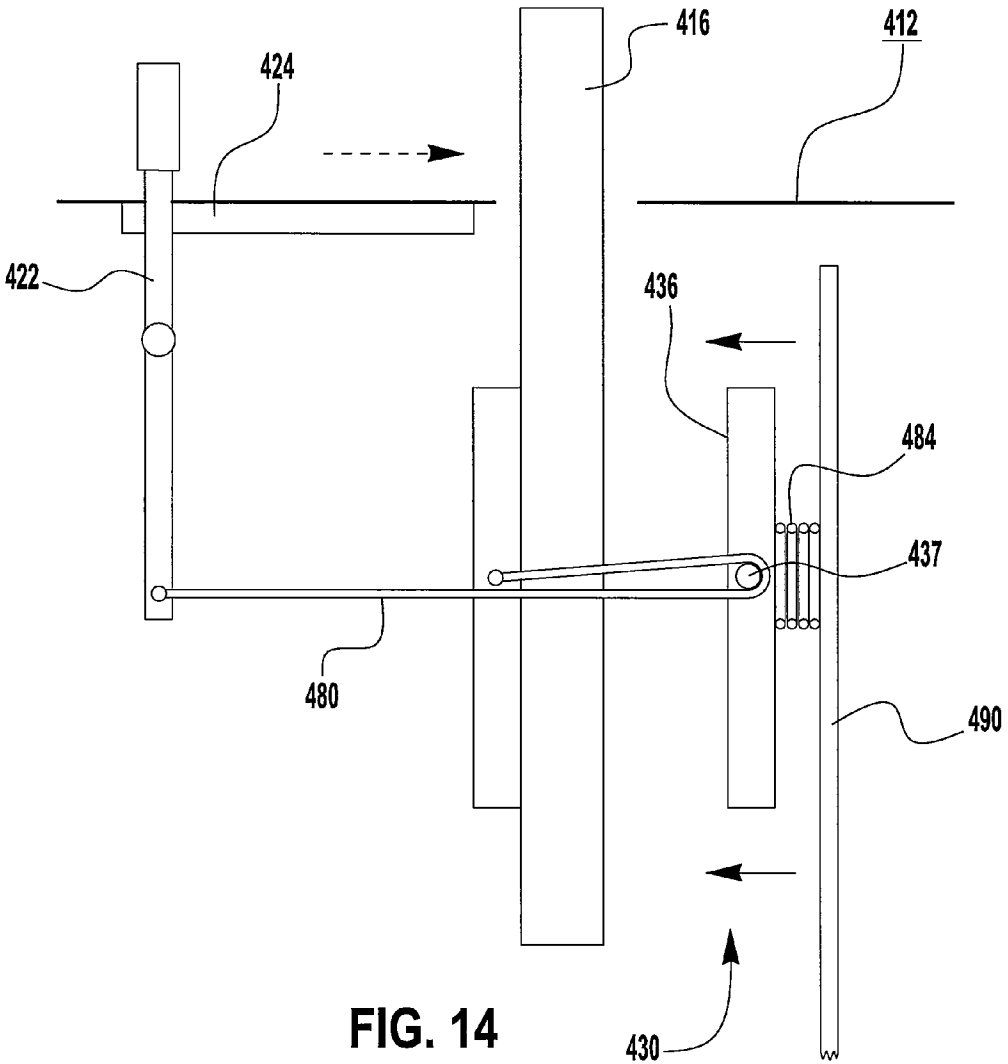
FIG. 14 is an elevational view of a clamp for a saw accessory in an open position in accordance with another non-limiting embodiment of the present invention.
Figure 15:
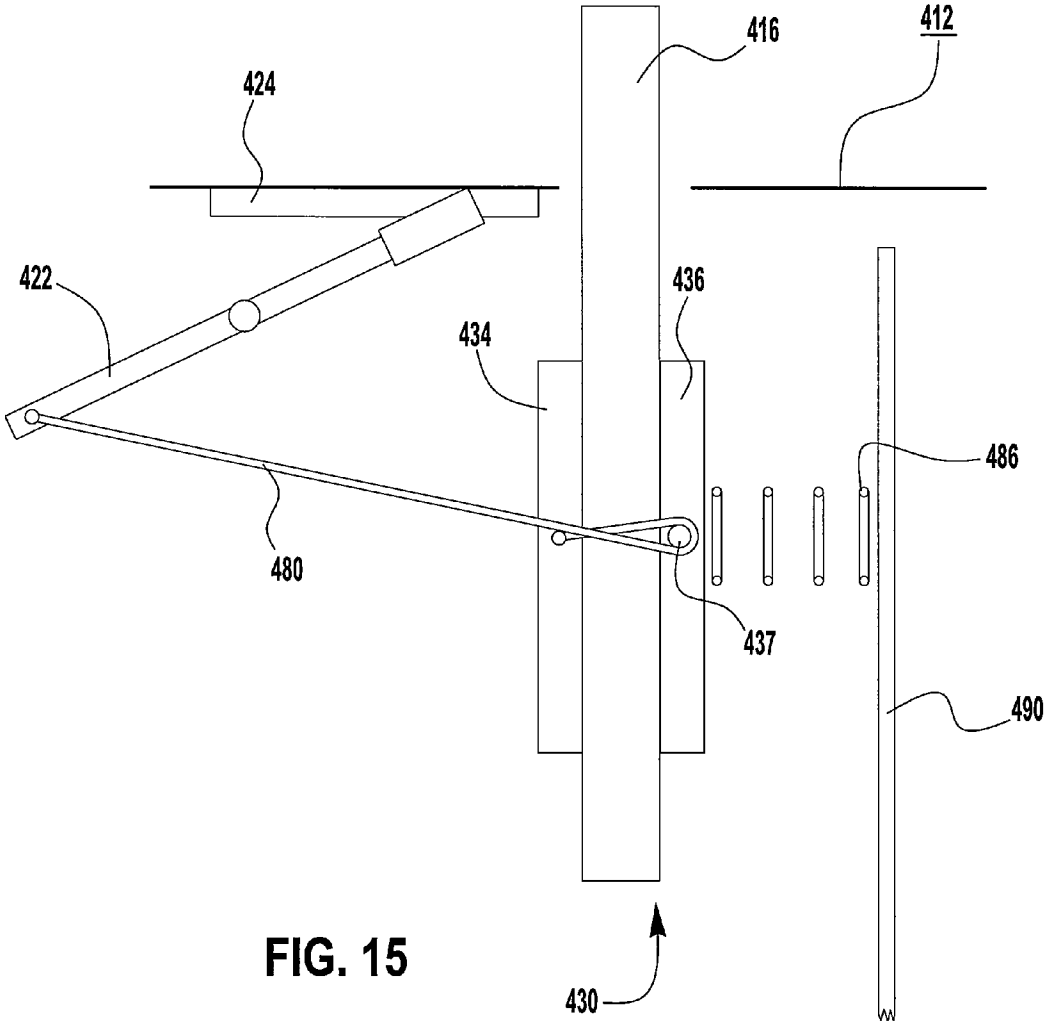
FIG. 15 is an elevational view of the clamp of FIG. 14 in a closed position.

In various embodiments, a clamp assembly can include a tension spring which can be configured to bias a jaw member into an open position. In at least one embodiment, referring to FIGS. 14 and 15, clamp assembly 430 can include tension spring 484 which can be can be configured to pull jaw member 436 into an open position. In various embodiments, cable 480 can be operably connected to lever 422 and jaw member 434 such that, when lever 422 is rotated, lever 422 can pull on cable 480 and slide jaw member 436 into engagement with saw accessory 416. In at least one embodiment, cable 480 can be wrapped, or positioned, around fulcrum 437 mounted to second jaw member 436, for example, such that, when a force is applied through cable 480, the force can extend spring 484 relative to mount 490 and allow a compressive force to be applied to saw accessory 416 by jaw members 434 and 436. In at least one embodiment, similar to the above, the saw can include a lock mechanism in slot 424, and/or mounted relative to surface 412, for holding lever 422 in the position illustrated in FIG. 15. In order to unclamp saw accessory 416, the lock mechanism can be released which can allow spring 484 to pull jaw member 436 into an open position. Correspondingly, by pulling jaw member 436 into an open position, spring 484 can also pull lever 422 into the position illustrated in FIG. 14.

In various circumstances, the clamping force that can be applied to a saw accessory by a clamp assembly will often depend upon the thickness of the saw accessory, or saw accessory attachment portion, positioned between the clamping members. More particularly, in at least one embodiment, a clamping assembly having a biasing spring may be able to provide a greater clamping force to thicker saw accessories than thinner saw accessories. According to Hooke's Law, the force that can be applied by a spring is proportional to the distance in which the spring is compressed and, thus, in various embodiments, a thicker saw accessory may be able to compress the biasing spring a greater distance than a thinner saw accessory. Accordingly, such a spring would apply a greater compression force to the thicker saw accessory. In various circumstances, as a result, thinner saw accessories may, as they may receive a lower clamping force, be more susceptible to undesirable movement within the clamp assembly than thicker saw accessories. In such circumstances, the reliability and the operator's confidence in the saw accessory may be reduced.

Figure 17:
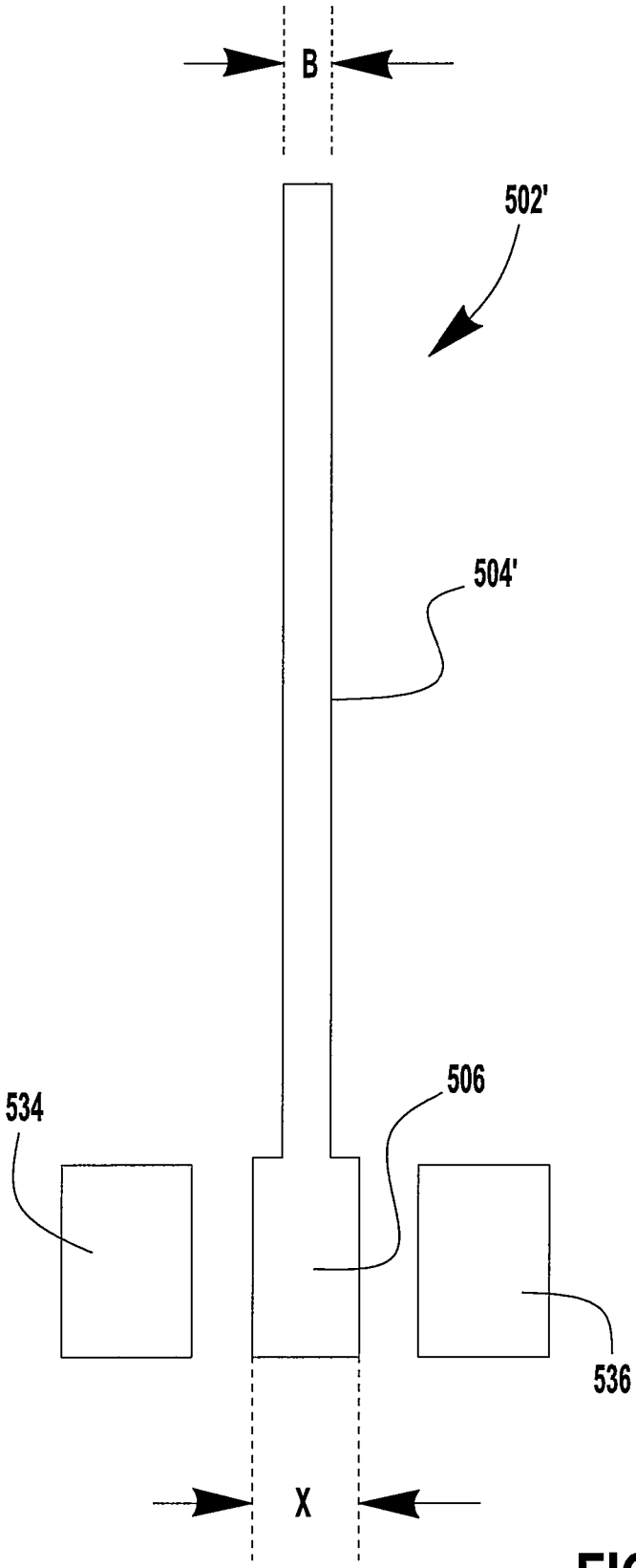
FIG. 17 is an elevational view of a saw accessory having an attachment portion which has the same thickness as the attachment portion of the saw accessory of FIG. 16, but which has a kerf portion having a different thickness.
Figure 18:
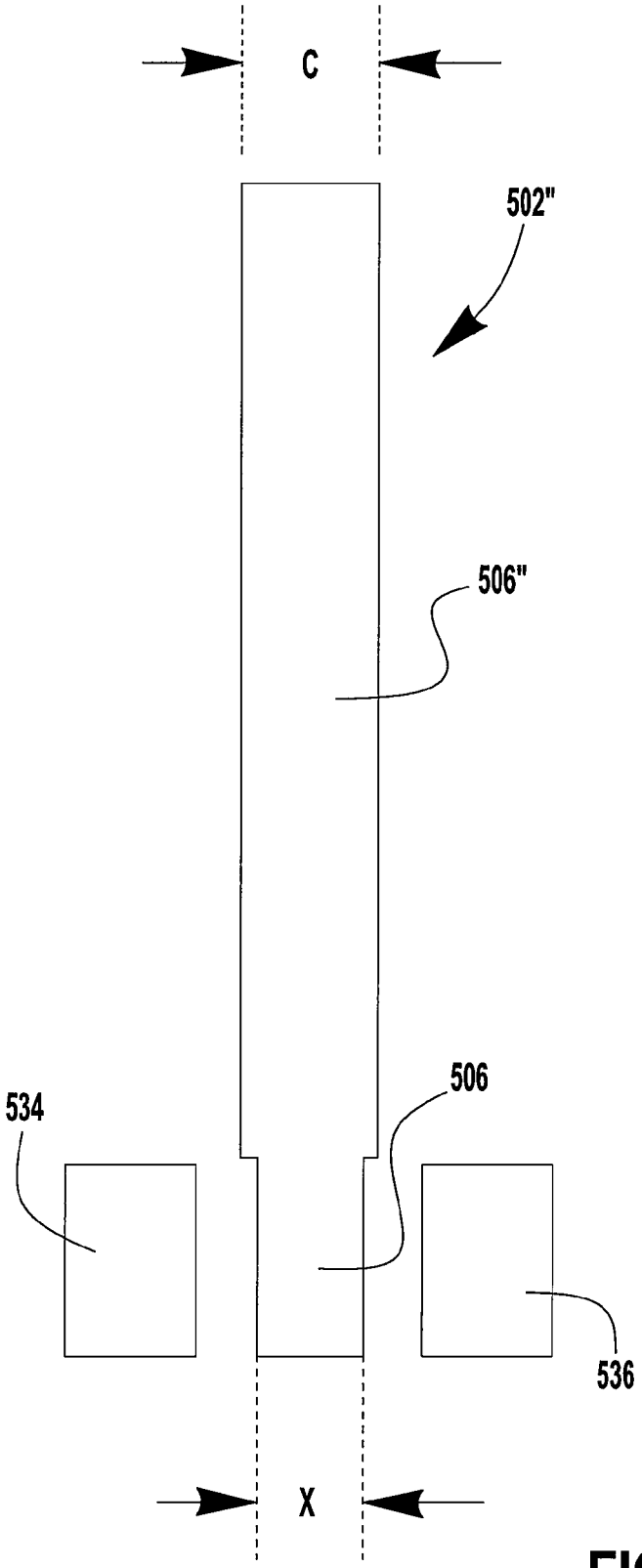
FIG. 18 is an elevational view of a saw accessory having an attachment portion which has the same thickness as the attachment portion of the saw accessory of FIG. 16, but which has a kerf portion having a different thickness.

In order to alleviate the problem discussed above, in various embodiments, a kit of riving knifes can be provided where each riving knife in the kit can include a clamp assembly attachment portion with the same, or substantially the same, thickness such that a clamp assembly can apply an identical, or substantially similar, compressive force to each riving knife in the kit and reliably hold each riving knife therein. Stated another way, the clamp assembly can include a spring which can be compressed the same, or substantially the same, distance when clamping any one of the riving knifes of the kit such that the force applied to each riving knife is the same, or substantially the same, owing to Hooke's law as discussed above. While the attachment portions of such riving knifes can have an identical or similar thickness as described above, the kerf insert portions of the riving knifes can have different thicknesses in order to accommodate different kerf widths created by the saw blade in the workpiece. For example, referring to FIGS. 16-18, a riving knife kit can include a plurality of riving knives 502, 502', and 502" where each of riving knifes 502, 502' and 502" of the kit can include the same, or a substantially similar, attachment portion 506 while having different kerf portions as described in greater detail below.

Figure 16:
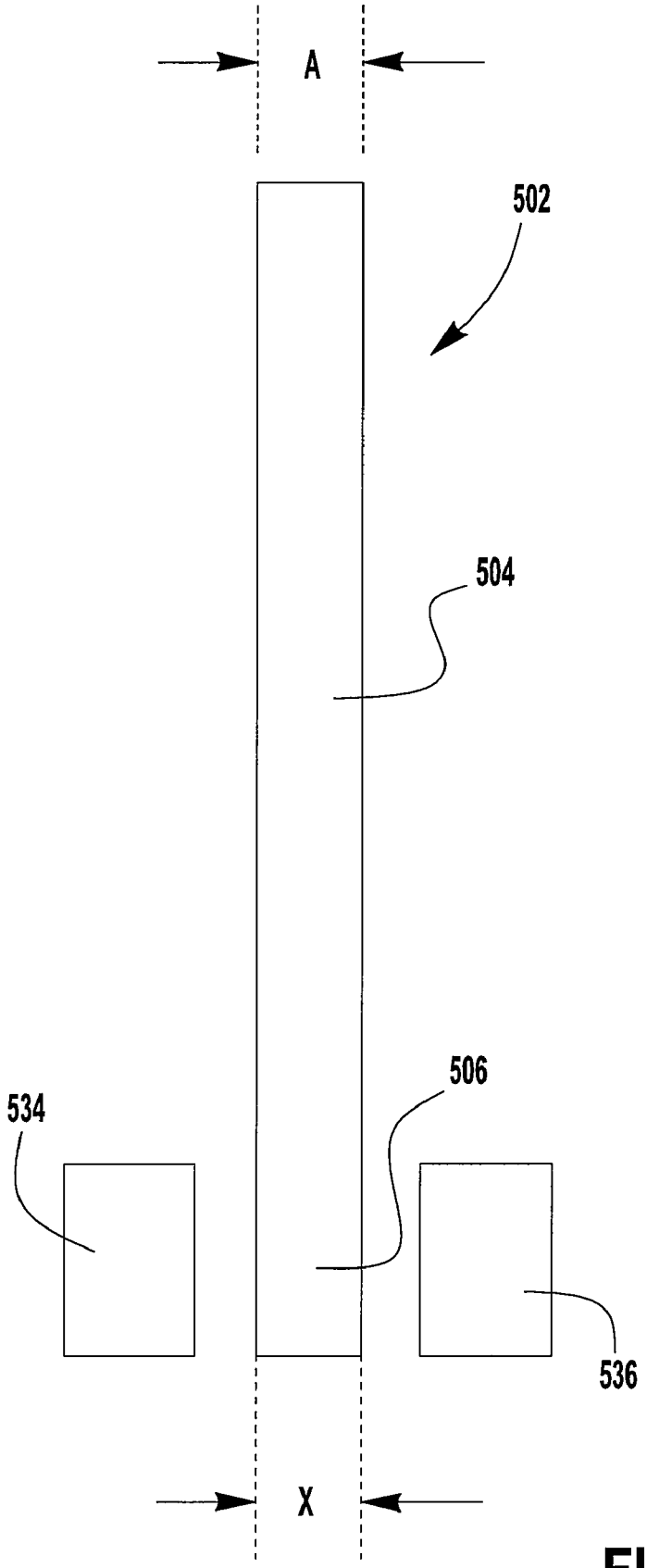
FIG. 16 is an elevational view of a saw accessory having an attachment portion which has the same thickness as a kerf portion.

Further to the above, riving knife 502 can include kerf portion 504 (FIG. 16), riving knife 502' can include kerf portion 504' (FIG. 17), and riving knife 502" can include kerf portion 504" (FIG. 18), for example. In at least one embodiment, each kerf portion can include a first outer surface 505 configured to align with a first sidewall of the kerf in the workpiece and, in addition, a second outer surface 507 configured to be aligned with a second sidewall of the kerf. In various embodiments, the distance between the first and second outer surfaces of the kerf portions can define a thickness of the kerf portions. In at least one embodiment, as illustrated in FIG. 16, kerf portion 504 can have a thickness "A" which can be equal to, or substantially equal to, a thickness "X" of attachment portion 506. In various embodiments, referring to FIG. 17, kerf portion 504' can have a thickness "B" which is thinner than thickness "X" of attachment portion 506. Similarly, referring to FIG. 18, kerf portion 504" can have a thickness "C" which is thicker than thickness "X" of attachment portion 506. In various embodiments, as a result, the attachment portions of the riving knifes can allow the clamp assembly to reliably hold the riving knifes in position regardless of which riving knife of the kit is used. While only three riving knives are illustrated in the exemplary embodiment, it is to be understood that any suitable number of riving knifes with any suitable kerf and attachment portion thicknesses can be provided in the kit.

While the present invention has been illustrated with reference to a riving knife, those skilled in the art will recognize that, in various embodiments, the present invention can be applied to any saw accessory or safety device such as a blade guard, and/or an anti-kick-back pawl, for example. Furthermore, while this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A saw, comprising:

a work surface configured to support a work piece;

a motor configured to motivate a cutting member;

a saw accessory comprising one of a riving knife and a cutting member guard configured to be positioned relative to the cutting member;

a first clamping member;

a second clamping member, wherein at least a portion of the saw accessory is configured to be disposed intermediate said first and second clamping members, wherein said first clamping member and said second clamping member are positioned below said work surface and are configured to hold at least a portion of said saw accessory above said work surface, wherein said first clamping member is movable between an unclamped position and a clamped position, wherein said first clamping member and said second clamping member define a slot therebetween, and wherein the saw accessory is configured to slide relative to said work surface within said slot when said first clamping member is in said unclamped position;

an actuator, wherein said actuator is configured to move said first clamping member relative to said second clamping member to clamp the saw accessory therebetween; and a controller, wherein said controller is in communication with said actuator and is configured to activate said actuator, wherein said controller is in electrical communication with said actuator.

2. The saw of claim 1, wherein said actuator is configured to move said second clamping member relative to said first clamping member to clamp the saw accessory therebetween.

3. The saw of claim 1, wherein said cutting member comprising a circular blade.

4. The saw of claim 1, wherein said actuator is one of a solenoid and an electric motor.

5. The saw of claim 1, wherein said controller comprises a switch configured to actuate said actuator, and wherein said switch is accessible to an operator of the saw.

6. The saw of claim 1, wherein said actuator further comprises at least one of a wireless transmitter and a wireless receiver, and wherein said controller further comprises at least one of a wireless transmitter and a wireless receiver.

7. A saw, comprising:

a work surface;

a motor configured to motivate a cutting member;

a riving knife;

a first clamping member;

a second clamping member, wherein at least a portion of said riving knife is configured to be disposed intermediate said first and second clamping members, wherein said first clamping member is movable between an unclamped position and a clamped position, wherein said riving knife is slidable relative to said first clamping member and said second clamping member along a first axis and a second axis when said first clamping member is in said unclamped position, wherein said first axis is not parallel to said second axis, and wherein said first axis is not collinear with said second axis;

an actuator, wherein said actuator is configured to move said first clamping member relative to said second clamping member to clamp said riving knife therebetween; and a controller, wherein said controller is in electrical communication with said actuator and is configured to activate said actuator.

8. The saw of claim 7, wherein said actuator is one of a solenoid and an electric motor.

9. The saw of claim 7, wherein said actuator is configured to move said second clamping member relative to said first clamping member to clamp said riving knife therebetween.

10. The saw of claim 7, wherein said controller comprises a switch configured to actuate said actuator, and wherein said switch is accessible to an operator of the saw.

11. The saw of claim 7, wherein said actuator further comprises at least one of a wireless transmitter and a wireless receiver, and wherein said controller further comprises at least one of a wireless transmitter and a wireless receiver.

12. The saw of claim 7, wherein said cutting member comprising a circular blade.

13. A saw, comprising:

a work surface configured to support a work piece;

a motor configured to motivate a cutting member;

a saw accessory comprising one of a riving knife and a cutting member guard configured to be positioned relative to the cutting member;

a first clamping member;

a second clamping member, wherein at least a portion of said saw accessory is configured to be disposed intermediate said first and second clamping members, wherein said first clamping member and said second clamping member are positioned below said work surface and are configured to hold at least a portion of said saw accessory above said work surface, wherein said first clamping member is movable between an unclamped position and a clamped position, wherein said first clamping member and said second clamping member define a gap therebetween, and wherein said saw accessory is configured to slide relative to said work surface within said gap when said first clamping member is in said unclamped position;

an electrical actuator, wherein said electrical actuator is configured to move said first clamping member relative to said second clamping member to clamp said saw accessory therebetween; and a controller, wherein said controller is in electrical communication with said electrical actuator and is configured to activate said electrical actuator.

14. The saw of claim 13, wherein said electrical actuator is one of a solenoid and an electric motor.

15. The saw of claim 13, wherein said electrical actuator is configured to move said second clamping member relative to said first clamping member to clamp said saw accessory therebetween.

16. The saw of claim 13, wherein said controller comprises a switch configured to actuate said electrical actuator, and wherein said switch is accessible to an operator of the saw.

17. The saw of claim 13, wherein said electrical actuator further comprises at least one of a wireless transmitter and a wireless receiver, and wherein said controller further comprises at least one of a wireless transmitter and a wireless receiver.

18. The saw of claim 13, wherein said cutting member comprising a circular blade.

* * * * *